US006205679B1

(12) United States Patent
Rodway et al.

(10) Patent No.: US 6,205,679 B1
(45) Date of Patent: Mar. 27, 2001

(54) DEVICE AND METHOD FOR DRYING JOINT COMPOUND WITH A SUPPORTED HEATED AIR SOURCE

(76) Inventors: William F. Rodway, 400 E. Street Rd., Apt. 80, Feasterville, PA (US) 19053; Andrew J. Drach, 240 E. County Line Rd., Apt. A-4, Hatboro, PA (US) 19040

( * ) Notice: Subject to any disclaimer, the term of this patent is extended or adjusted under 35 U.S.C. 154(b) by 0 days.

(21) Appl. No.: 09/320,683

(22) Filed: May 27, 1999

(51) Int. Cl.[7] ..... F26B 3/00
(52) U.S. Cl. ..... 34/487; 34/90; 34/97
(58) Field of Search ..... 34/90, 91, 96, 34/97, 283, 427, 443, 487; 248/284.1, 288.31, 314, 315; 392/380, 382, 384; 416/244 R, 246

(56) References Cited

U.S. PATENT DOCUMENTS 2,139,001 * 12/1938 Cole ..... 34/97 X
4,595,008 * 6/1986 Guibert ..... 128/399
5,064,154 11/1991 Payne ..... 248/121
5,558,501 * 9/1996 Wang et al. ..... 416/244 R
5,613,305 * 3/1997 Narrin ..... 34/97 X
5,737,847 * 4/1998 Britton ..... 34/97
5,832,624 * 11/1998 Narrin ..... 34/97
5,937,537 * 8/1999 Miller ..... 34/97
5,956,861 * 9/1999 Barnes ..... 34/97 X
5,970,622 * 10/1999 Bahman ..... 34/97

* cited by examiner

*Primary Examiner*—Stephen Gravini
(74) *Attorney, Agent, or Firm*—LaMorte & Associates P.C.

(57) ABSTRACT

A device for supporting a heated air source at a targeted segment of a wall or ceiling in a room. The device includes a pole having a first end and a second end. The pole is selectively adjustable in length, wherein the pole can be adjusted to the height of a ceiling in a variety of different rooms. A clamping mechanism is provided that selectively attaches to the pole at any point between the first end of the pole and the second end of the pole. The clamping mechanism includes a mounting bracket and a support platform that extends from said mounting bracket. The support platform can be moved into numerous different orientations. An attachment mechanism is coupled to the support platform, wherein the attachment mechanism selectively attaches the heated air source to the support platform. As such, the heated air source is capable of being directed toward any section of a room's ceiling or walls.

16 Claims, 2 Drawing Sheets

DEVICE AND METHOD FOR DRYING JOINT COMPOUND WITH A SUPPORTED HEATED AIR SOURCE

BACKGROUND OF THE INVENTION

1. Field of the Invention

In general, the present invention relates to portable drying devices that are used to dry different applied materials such as paint, joint compound and the like. More particularly, the present invention is related to portable drying devices that are adapted to dry different areas of material that have been applied to a ceiling or wall.

2. Description of the Prior Art

When a contractor installs drywall on a ceiling or wall, different sheets of drywall are placed in abutment. The abutment between sheets of drywall are called seams. The seams of the drywall are typically covered with joint compound to create a smooth, uninterrupted surface. However, the joint compound is not applied in a single step operation. Rather, a first coat of joint compound is applied to the seams of the drywall. The first coat of joint compound is used to retain a paper or fiberglass joint tape in place. After the initial coat of joint compound dries, a rough sanding procedure is typically performed and a second coat of joint compound is applied. The second coat of joint compound is blended into the plane of the drywall, thereby eliminating the seam.

When the second coat of joint compound dries, the drywall is sanded to better blend the joint compound into the plane of the drywall. In certain applications, a third layer of joint compound may be applied to eliminate any flaws that were present in the second application of joint compound.

Depending upon the type of joint compound being used and other variables, such as air temperature and humidity, joint compound may take up to several hours to fully dry. Accordingly, if a contractor were to rapidly finish the application of a first coat of joint compound, that contractor cannot start the second coat of joint compound until the first coat dries. This causes a drywall contractor to waste time waiting for joint compound to dry, thereby greatly extending the amount of time required by a contractor to finish a job.

In an attempt to shorten the amount of time required for joint compound to dry, contractors often use fans to blow air past the drying joint compound. The use of a fan can quicken the dry time of joint compound by over fifty percent. However, thicker sections of joint compound can still take hours to dry. To further increase the speed at which joint compound dries, many contractors actively dry the joint compound with blow driers or other heated air sources. Using a heated air source, sections of joint compound can be dried in a fraction of the time previously required.

In order to use a heated air source, such as a blow drier, a contractor must hold the heated air source in close proximity to the wet joint compound. This requires a great deal of time and labor on behalf of the contractor. A need therefore exists for a device that can hold the heated air source in different positions for the contractor. In this manner, a contractor can dry one section of joint compound while applying another section of joint compound. In this manner, little time is wasted waiting for the joint compound to dry.

In the prior art, there are many devices that have been designed to hold a heated air source, such as a hair dryer, in a particular position. Many such prior art devices were designed to hold a hair dryer near a person's head so that they can use both their hands while drying their hair. Such prior art devices are exemplified by U.S. Pat. No. 5,064,154 to Payne, entitled, Stand And Holder For Hair Dryer.

A problem associated with such prior art hair dryer holders is that they lack the range of movement required to be useful in drying joint compound. Drywall is the material of choice when constructing interior walls and ceilings. Accordingly, joint compound is applied up and down the full length of walls and across the entire length of ceilings. In order for a support for a heated air source to be useful, it must be able to support the heated air source in a variety of different orientations from heights ranging from ground level to up to twelve feet. Such a device is set forth by the present invention as claimed and described below.

SUMMARY OF THE INVENTION

The present invention is a device for supporting a heated air source at a targeted segment of a wall or ceiling in a room. The device includes a pole having a first end and a second end. The pole is selectively adjustable in length, wherein the pole can be adjusted to the height of a ceiling in a variety of different rooms. A clamping mechanism is provided that selectively attaches to the pole at any point between the first end of the pole and the second end of the pole. The clamping mechanism includes a mounting bracket and a support platform that extends from said mounting bracket. The support platform can be moved into numerous different orientations. An attachment mechanism is coupled to the support platform, wherein the attachment mechanism selectively attaches the heated air source to the support platform. As such, the heated air source is capable of being directed toward any section of a room's ceiling or walls.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention device can be used to apply heated air to many different objects and surfaces, such as piping, paint and the like, the present invention is particularly well suited for applying heated air to joint compound. Accordingly, by way of example, the present invention device will be described in an application where the device is used to dry joint compound applied to a wall or ceiling.

Figure 1:
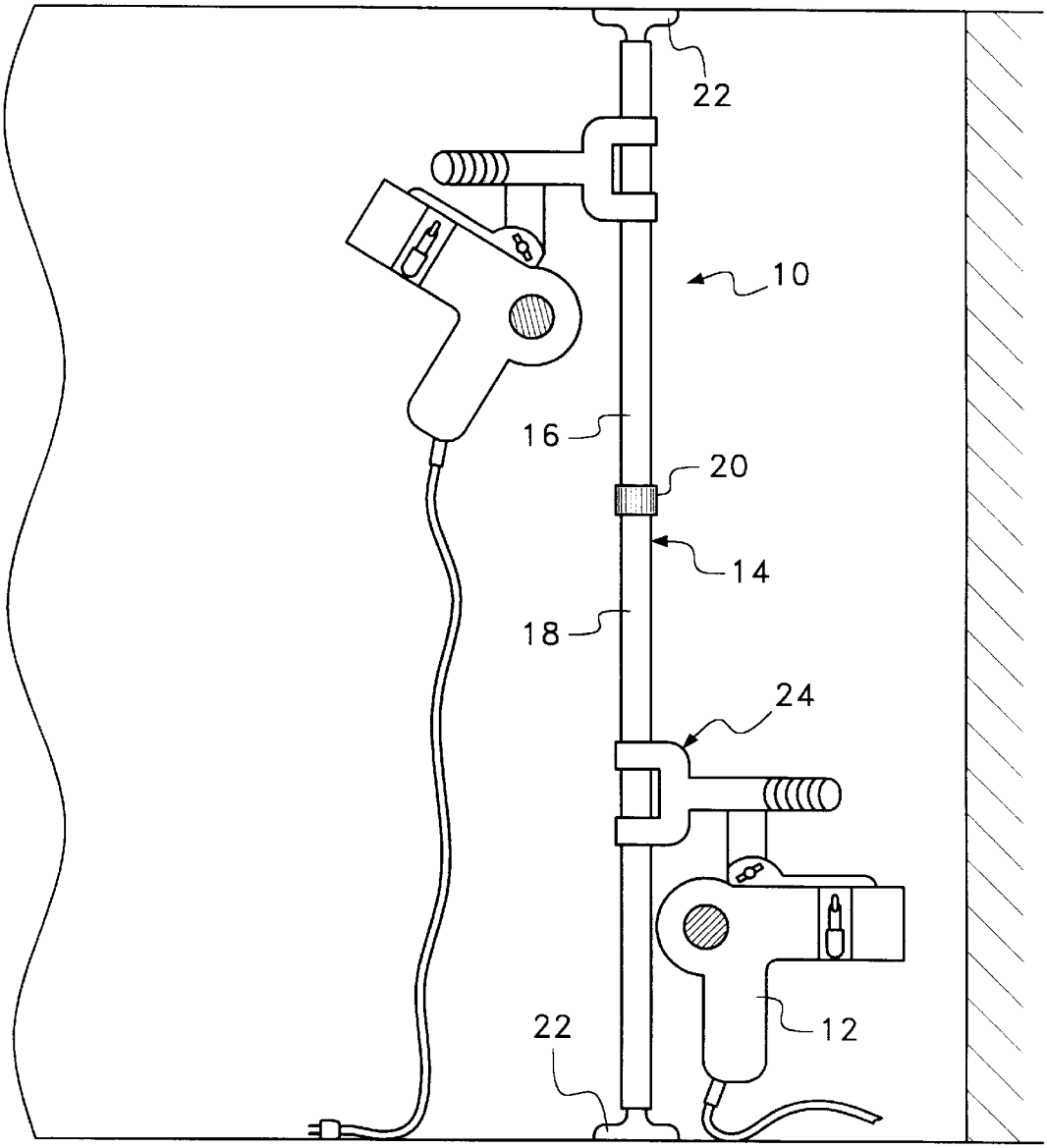
FIG. 1 is front view of an exemplary embodiment of the present invention device shown in a room with a ceiling, floor and walls.

Referring to FIG. 1, an embodiment of the present invention device 10 is shown in conjunction with a traditional prior art hair dryer 12 and a segment of wall upon which joint compound has been applied. The present invention device 10 includes a support pole 14. The support pole 14 is adjustable in height between a preferred range of six feet and at least ten feet. However, shorter or longer poles can be used. In the shown embodiment, the support pole 14 has a telescopic construction, wherein a small diameter shaft 16 passes into a larger diameter tube 18. A collar mechanism 20 is disposed at the top end of the larger diameter tube 18. The collar mechanism 20 can be selectively tightened and loosed, thereby locking the small diameter shaft 16 into position relative the larger diameter tube 18.

The prior art is replete with numerous different pole configurations that can be selectively adjusted in length. The support pole 14 described is merely exemplary and it should be understood that most any such prior art pole assembly can be adapted for use in the present invention.

The support pole 14 has two ends. The distance between the two ends is adjusted by the various length adjustment mechanisms adapted for use within the structure of the support pole 14. A suction cup 22, or other elastomeric padding element is present at both the top end of the support pole 14 and at the bottom end of the support pole 14. As such, the support pole 14 can be interposed in a self-supporting manner in between the ceiling and the floor of a room, without harming either the ceiling or the floor.

A clamp mechanism 24 is provided that is designed to engage the support pole 14 at most any point along its length. The clamp mechanism 24 attaches to a heated air source 12, such as a hair dryer, heated paint remover or the like. The clamp mechanism 24 enables the heated air source 12 to be manipulated into numerous orientations. As such, the heated air source 12 can be manipulated to blow air onto any point on a wall near the support pole 14 or on the ceiling near the top of the support pole 14.

Accordingly, to use the present invention device 10, the support pole 14 is first adjusted in height and applied between the ceiling and the floor near the area of joint compound that is to be dried. A heated air source 12 is attached to the clamp mechanism 24 and the clamp mechanism 24 is attached to the support pole 14. Using the adjustable features of the clamp mechanism 24, the heated air source 12 is oriented to direct a stream of hot air at a targeted area of joint compound on the wall or ceiling. As one area of joint compound becomes dry, the clamp mechanism 24 can be moved or the support pole 14 can be moved so that the heated air source 12 is now directed at a new area of joint compound. This process is continued until all of the joint compound is dried on both the ceiling and the walls.

Figure 2:
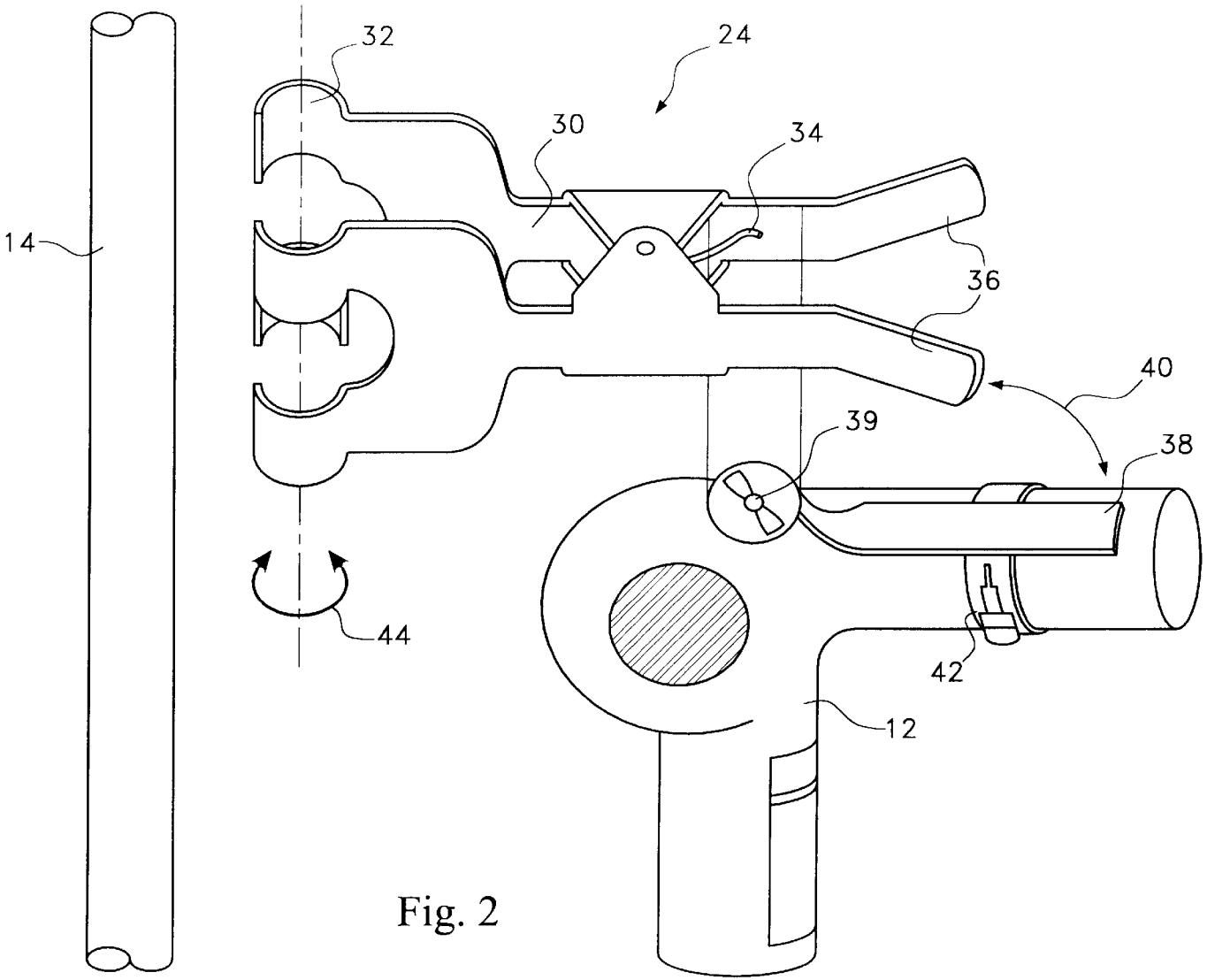
FIG. 2 is a perspective view of the clamping mechanism in accordance with one exemplary embodiment of the present invention device.

Referring to FIG. 2, it can be seen that the clamp mechanism 24 includes a mounting bracket 30 having clamp jaws 32 at one end. The clamp jaws 32 are used to selectively engage the support pole 14. The clamp jaws 32 are biased closed by a spring 34 and are opened by the manual manipulation of handles 36 which act against the bias of the spring 34.

The heated air source 12 is attached to a support platform 38 that is attached to the mounting bracket 30 at a pivotable connection 39. Accordingly, the support platform 38 can be selectively rotated around the pivot connection 39 in the directions of arrow 40. This enables the angle of the support platform 38 to be selectively altered relative the mounting bracket 30 and the pole 14.

In the shown embodiment, the heated air source 12 attaches to the support platform 38 with a flexible coupling 42. The flexible coupling can be a flexible clamp, strap or any other type of fastener capable of engaging the cylindrical shape of a hair dryer nozzle. In alternate embodiments, a flexible coupling need not be used. Rather, an aperture can be formed in the support platform through which the handle of the heater air source 12 passes. Gravity then retains the heated air source 12 in place within the support platform.

By rotating the clamp mechanism 24 on the pole, the heated air source 12 can be selectively adjusted in the directions of arrow 44. By selectively moving the clamp mechanism 24 up and down the support pole 14, the heated air source 12 can be vertically adjusted. Lastly, by changing the angle of the support platform 38 relative the mounting bracket 30, the heated air source 12 can be selectively adjusted in the direction of arrows 40.

The clamping mechanism 24 of FIG. 1 and FIG. 2 is merely exemplary. There are numerous different clamping mechanisms that are designed to selectively clamp to poles. Many such clamping mechanisms can be adapted for use in the practice of the present invention device. Furthermore, the shape of the shown mounting bracket 30 (FIG. 2) and clamp jaws 32 (FIG. 2) is also merely exemplary. Numerous other bracket configurations can also be used in a manner that is functionally equivalent to the embodiment shown. Similarly, the pivotable connection 39 between the mounting bracket 30 and the support platform 38 can also be varied using a variety of different pivot connections, ball and socket connections or universal joint connections.

As a consequence, it will be understood that the specifics of the present invention described above illustrates only one exemplary embodiment of the present invention. A person skilled in the art can therefore make numerous alterations and modifications to the shown embodiment utilizing functionally equivalent components to those shown and described. All such modifications are intended to be included within the scope of the present invention as defined by the appended claims.

What is claimed is:

1. A device for supporting a heated air source in a room having a ceiling and a floor, said device comprising:

a pole having a first end, a second end and a selectively adjustable length between said first end and said second end;

a first flexible suction cup coupled to said first end of said pole;

a second flexible suction cup coupled to said second end of said pole, wherein said pole can be selectively adjusted in length between said first flexible suction cup and said second flexible suction cup so that said first flexible suction cup is biased against the ceiling by said pole and said second flexible suction cup is biased against the floor by said pole;

a clamping mechanism selectively attachable to said pole at any point between said first end and said second end, wherein said clamping mechanism includes a mounting bracket and a support platform extending from said mounting bracket;

an attachment mechanism for selectively attaching the heated air source to said support platform.

2. The device according to claim 1, wherein said support platform is pivotably connected to said mounting bracket.

3. The device according to claim 1, wherein said selectively adjustable length is between six feet and ten feet.

4. The device according to claim 1, wherein said clamping mechanism includes jaws that engage said pole and are biased against said pole by at least one spring.

5. In a room having a floor and ceiling, a device for supplying heated air in a desired direction, comprising:

a pole having a first end and a second end;

a first flexible suction cup coupled to said first end of said pole;

a second flexible suction cup coupled to said second end of said pole, wherein said pole is positionable between the ceiling and floor so that said first flexible suction cup abuts against the ceiling and said second flexible suction cup abuts against the floor;

a clamping mechanism selectively attachable to said pole at various points between said first end and said second end; and a heated air source coupled to said clamping mechanism.

6. The device according to claim 5, wherein said clamping mechanism contains adjustable elements that enable said heated air source to be selectively altered in orientation with respect to said pole.

7. The device according to claim 5, wherein said clamping mechanism includes a mounting bracket and a support platform that extends from said mounting bracket, wherein said heated air source attaches to said support platform.

8. The device according to claim 7, wherein said support platform is pivotably connected to said mounting bracket.

9. The device according to claim 5, wherein said heated air source is a portable hair dryer.

10. The device according to claim 5, wherein said pole has a length between said first end and said second end that is between six feet and ten feet.

11. A method directing heated air onto a targeted surface within a room, comprising the steps of:

providing an adjustable length pole having a first flexible suction cup at one end and a second flexible suction cup at an opposite end;

placing said pole between a floor and a ceiling in the room at a point proximate said targeted surface, wherein the pole biases the first flexible suction cup against the ceiling an biases the second flexible suction cup against the floor;

attaching a heated air source to a support platform;

attaching said support platform to said pole at a position between said top end and said bottom end; and orienting said support platform so that said heated air source directs heated air toward said targeted surface.

12. The method according to claim 11, wherein said heated air source is a portable hair dryer.

13. The method according to claim 11, wherein said step of attaching said support platform to said pole includes clamping a bracket to said pole, wherein said support platform extends from said bracket.

14. The method according to claim 13, wherein said step of orienting said support platform includes reorienting said support platform with respect to said bracket.

15. The device according to claim 1, wherein said clamping mechanism includes a set of spring biased clamping jaws, said clamping jaws being coupled to handles, whereby the manual squeezing of the handles selectively opens the clamping jaws and enables said clamping mechanism to be rapidly repositioned on said pole.

16. The device according to claim 5, wherein said clamping mechanism includes a set of spring biased clamping jaws, said clamping jaws being coupled to handles, whereby the manual squeezing of the handles selectively opens the clamping jaws and enables said clamping mechanism to be rapidly repositioned on said pole.

* * * * *